US009993083B2

(12) United States Patent
Choi

(10) Patent No.: US 9,993,083 B2
(45) Date of Patent: Jun. 12, 2018

(54) FOLDABLE CHAIR FRAME WITH INCLINED LEGS AND ANGLED BACKREST RODS AND FOLDABLE CHAIR HAVING SAME

(71) Applicant: Campvalley (Xiamen) Co. Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days. days.

(21) Appl. No.: 15/425,852

(22) Filed: Feb. 6, 2017

(65) Prior Publication Data

US 2017/0224116 A1 Aug. 10, 2017

(30) Foreign Application Priority Data

Feb. 4, 2016 (CN) ..... 2016 2 0113284 U

(51) Int. Cl.
*A47C 4/28* (2006.01)

(52) U.S. Cl.
CPC ..... *A47C 4/286* (2013.01)

(58) Field of Classification Search
CPC .. A47C 4/286; A47C 7/40; A47C 7/54; A47C 7/407
USPC ..... 297/45, 42
See application file for complete search history.

(56) References Cited

U.S. PATENT DOCUMENTS

| | | | | |
|---|---|---|---|---|
| 291,062 | A | 1/1884 | Latour | |
| 2,459,843 | A | 1/1949 | Scholander | |
| 2,712,349 | A | 7/1955 | Le Voir | |
| 3,093,407 | A | 8/1983 | Wilson | |
| 5,356,107 | A | 10/1994 | Sinohuiz | |
| 5,501,505 | A | 3/1996 | Jablonski | |
| 5,527,089 | A | 6/1996 | Charest | |
| 5,620,227 | A | 4/1997 | Brune | |
| 5,851,052 | A * | 12/1998 | Gustafsson | A47C 4/286 248/164 |
| 5,893,605 | A | 4/1999 | Chang | |
| 6,082,813 | A | 7/2000 | Chen | |
| 6,179,374 | B1 | 1/2001 | Tang | |
| 6,247,749 | B1 | 6/2001 | Yu | |

(Continued)

FOREIGN PATENT DOCUMENTS

| | | |
|---|---|---|
| CN | 201480624 U | 5/2010 |
| DE | 195 40 528 A1 | 5/1996 |
| WO | WO 2005/112703 A1 | 12/2005 |

*Primary Examiner* — Milton Nelson, Jr.

(74) *Attorney, Agent, or Firm* — Morgan, Lewis & Bockius LLP

(57) ABSTRACT

Disclosed are foldable chair frames and foldable chairs. A foldable chair frame includes left and right side frames, each having a front leg, a backrest rod, a rear leg, and a seat rod. The backrest rod is integrally formed with the front leg and extended from the upper end of the front leg at an obtuse angle with respect to the front leg. The rear leg has an upper end configured to abut and support the front leg when the foldable chair frame is unfolded. The seat rod is pivotally connected to the front and rear legs. A foldable chair frame also includes front and rear supporting rods disposed between the left and right side frames at front and rear sides of the foldable chair frame. The front and rear supporting rods are pivotally connected to the left and right side frames.

22 Claims, 5 Drawing Sheets

(56) References Cited

U.S. PATENT DOCUMENTS

| | | | | |
|---|---|---|---|---|
| 6,302,479 | B1 | 10/2001 | Zheng | |
| 6,322,646 | B1 | 11/2001 | Chakrabarti et al. | |
| 6,634,705 | B1 | 10/2003 | Zheng | |
| 6,752,414 | B1 | 6/2004 | Waldron et al. | |
| 6,840,573 | B1 | 1/2005 | Yao | |
| 6,926,356 | B2 | 8/2005 | Chen | |
| 7,011,372 | B1 | 3/2006 | Hsieh | |
| 7,404,601 | B2 | 7/2008 | Chen | |
| 7,717,502 | B2 * | 5/2010 | Deng | A47C 4/20 297/16.1 |
| 7,717,503 | B1 | 5/2010 | Watson | |
| 7,758,111 | B2 | 7/2010 | Chen | |
| 8,100,469 | B2 | 1/2012 | Lougee | |
| 8,247,749 | B2 | 8/2012 | Doyon et al. | |
| 8,465,090 | B1 | 6/2013 | O'Connor | |
| 8,511,747 | B2 | 8/2013 | Lougee | |
| 9,204,729 | B2 | 12/2015 | Frankel | |
| 2002/0024240 | A1 | 2/2002 | Chen | |
| 2004/0135405 | A1 | 7/2004 | Zheng | |
| 2008/0249991 | A1 | 11/2008 | Hsieh | |
| 2010/0237555 | A1 | 9/2010 | Grace | |
| 2010/0308042 | A1 | 12/2010 | Fads | |
| 2011/0248037 | A1 | 10/2011 | Fung | |
| 2011/0248040 | A1 | 10/2011 | McGregor | |
| 2011/0303659 | A1 | 12/2011 | Perlman | |
| 2013/0264340 | A1 | 10/2013 | Zens | |
| 2015/0296023 | A1 | 10/2015 | Choi | |

* cited by examiner

FOLDABLE CHAIR FRAME WITH INCLINED LEGS AND ANGLED BACKREST RODS AND FOLDABLE CHAIR HAVING SAME

CROSS-REFERENCE TO RELATED APPLICATIONS

The present application claims priority to Chinese Utility Model Application CN 201620113284.X filed Feb. 4, 2016. The disclosure of the application is incorporated herein for all purposes by reference in its entirety.

FIELD OF THE INVENTION

The present invention generally relates to foldable chair frames and foldable chairs. More particularly, the present invention relates to foldable chair frames and foldable chairs with inclined legs and angled backrest rods.

BACKGROUND

Foldable chairs are widely used at homes, schools, hospitals, or other places. There are a variety of foldable chairs. FIG. 1 shows a foldable chair frame disclosed in Chinese Utility Model Publication No. CN 201480624, the content of which is incorporated herein for all purposes by reference in its entirety. The foldable chair frame includes left backrest rod 11', right backrest rod 12', left seat cushion rod 21', right seat cushion rod 22', left armrest rod 31', right armrest rod 32', left rear leg 41', right rear leg 42' and rear cross rods 5'. Front portions of left seat cushion rod 21' and right seat cushion rod 22' are movably connected with upper portions of left armrest rod 31' and right armrest rod 32'. Rear portions of left seat cushion rod 21' and right seat cushion rod 22' are movably connected with left rear leg 41' and right rear leg 42'. Middle-rear portions of left seat cushion rod 21' and right seat cushion rod 22' are movably connected with left backrest rod 11' and right backrest rod 12'. Bottom portions of left armrest rod 31' and right armrest rod 32' are movably connected with bottom portions of right backrest rod 12' and left backrest rod 11'. A middle portion of left armrest rod 31' is crossly and movably connected with a middle portion of right armrest rod 32'. Top portions of left rear leg 41' and right rear leg 42' are movably connected with left backrest rod 11' and right backrest rod 12'. Left sliding sleeve 61' and right sliding sleeve 62' are arranged at connecting positions. Left sliding sleeve 61' and right sliding sleeve 62' are nested in left backrest rod 11' and right backrest rod 12'. Armrest limiting sleeves 71' and 72' are arranged at upper portions of the left sliding sleeve and the right sliding sleeve. Bottom portions of left rear leg 41' and right rear leg 42' are respectively and movably connected with the bottom portions of the left and right sides of the rear cross rods. The top portions of the left and right sides of the rear cross rods are respectively and movably connected with the left and right backrest rods.

As the lower portions of left backrest rod 11' and right backrest rod 12' are used to serve as the front legs, left backrest rod 11' and right backrest rod 12' are inclined backward with an inclination angle the same as the front legs. In most cases, this inclination angle is outside of the comfort inclination angle range, and accordingly the backrest of such a chair cannot provide support and comfort to a user.

Given the current state of the art, there remains a need for foldable chair frames and foldable chairs that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable chair frames and foldable chairs that are comfortable and easy to fold and unfold.

In various exemplary embodiments, the present invention provides a foldable chair frame including left and right side frames, and a plurality of front and rear supporting rods. The left and right side frames are disposed at left and right sides of the foldable chair frame, respectively. Each of the left and right side frames includes a front leg, a rear leg, a backrest rod and a seat rod. The front leg has an upper end, a lower end, and a first pivotal point between the upper and lower ends. The backrest rod is integrally formed with the front leg and extended from the upper end of the front leg at an obtuse angle with respect to the front leg. The rear leg has an upper end, a lower end, and a second pivotal point between the upper and lower ends. The upper end of the rear leg is configured to abut and support the front leg when the foldable chair frame is unfolded. The seat rod has a rear end pivotally connected to the rear leg at the second pivotal point, and a middle portion pivotally connected to the front leg at the first pivotal point. The plurality of front supporting rods is disposed between the left and right side frames at a front side of the foldable chair frame, and pivotally connected to the left and right side frames. The plurality of rear supporting rods is disposed between the left and right side frames at a rear side of the foldable chair frame, and pivotally connected to the left and right side frames.

In some embodiments, the plurality of front supporting rods includes a pair of crossing front supporting rods disposed between the left and right side frames at the front side of the foldable chair frame. Each crossing front supporting rod in the pair has a lower end pivotally connected to a lower portion of the front leg of one of the left and right side frames, and an upper portion pivotally connected to a front portion of the seat rod of the other of the left and right side frames at a third pivotal point. In some embodiments, when the foldable chair frame is unfolded, the upper portion of each crossing front supporting rod in the pair extends upward, outward, or upward and outward, beyond the third pivotal point, the extended upper portion serving as an armrest.

In some embodiments, the plurality of rear supporting rods includes a pair of crossing rear supporting rods disposed between the left and right side frames at a rear side of the foldable chair frame. Each crossing rear supporting rod in the pair has a lower end pivotally connected to a lower portion of the rear leg of one of the left and right side frames and an upper end pivotally connected to the upper end or an upper end portion of the front leg of the other of the left and right side frames.

In some embodiments, the rear leg includes a holder at the upper end thereof to hold the front leg when the foldable chair frame is unfolded.

In some embodiments, the obtuse angle, the first pivotal point and the second pivotal point are configured such that when the foldable chair frame is unfolded, the front leg is inclined backward, the rear leg is inclined forward, and the backrest rod is inclined backward with an inclination angle less than an inclination angle of the front leg. In an embodiment, when unfolded, the seat rod is titled upward.

In some embodiments, each of the left and right side frames further includes a link having one end pivotally connected to the front leg at a fourth pivotal point between the upper end and the first pivotal point of the front leg, and the other end pivotally connected to the rear leg at a fifth pivotal point between the upper end and the second pivotal point of the rear leg. In an embodiment, the link includes two connecting pieces substantially parallel to each other, one on an interior side and the other on an exterior side of the foldable chair frame. In an embodiment, the fifth pivotal point is adjacent to the upper end of the rear leg.

In some embodiments, the foldable chair frame further includes a plurality of leg base covers, each coupled to a front or a rear leg at the lower end of the leg. In an embodiment, each leg base cover is sleeved onto the lower end of the front or rear leg. In an embodiment, the plurality of leg base covers is made of a plastic or a rubber.

In many embodiments, the present invention provides a foldable chair including a foldable chair frame disclosed herein and a chair cloth coupled to the foldable chair frame. In some embodiments, the chair cloth includes backrest cloth coupled to the backrest rods, a seat cloth coupled to the seat rods, and left and right armrest cloths disposed at left and right sides of the foldable chair. Each of the left and right armrest cloths has one end coupled to the corresponding front leg or backrest rod, and the other end coupled to the upper portion of the corresponding front support rod. In some embodiments, the backrest cloth and the seat cloth are made of one piece of fabric or are stitched together.

The foldable chair frames and foldable chairs of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of foldable chair frames and foldable chairs. In general, a foldable chair of the present invention includes a foldable chair frame and a chair cloth coupled to the foldable chair frame. A chair frame of the present invention includes legs and supporting rods pivotally coupled to each other. The foldable chair frames and foldable chairs can be of various sizes, e.g., a smaller size for children and a larger size for adults. Also, the foldable chair frames can made of various materials including but not limited to metals such as steel, and plastics. Further, the legs and the supporting rods can be hollow or solid, and the cross sections of the legs and the supporting rods can be the same or different in terms of the sizes and/or shapes.

Figure 3:
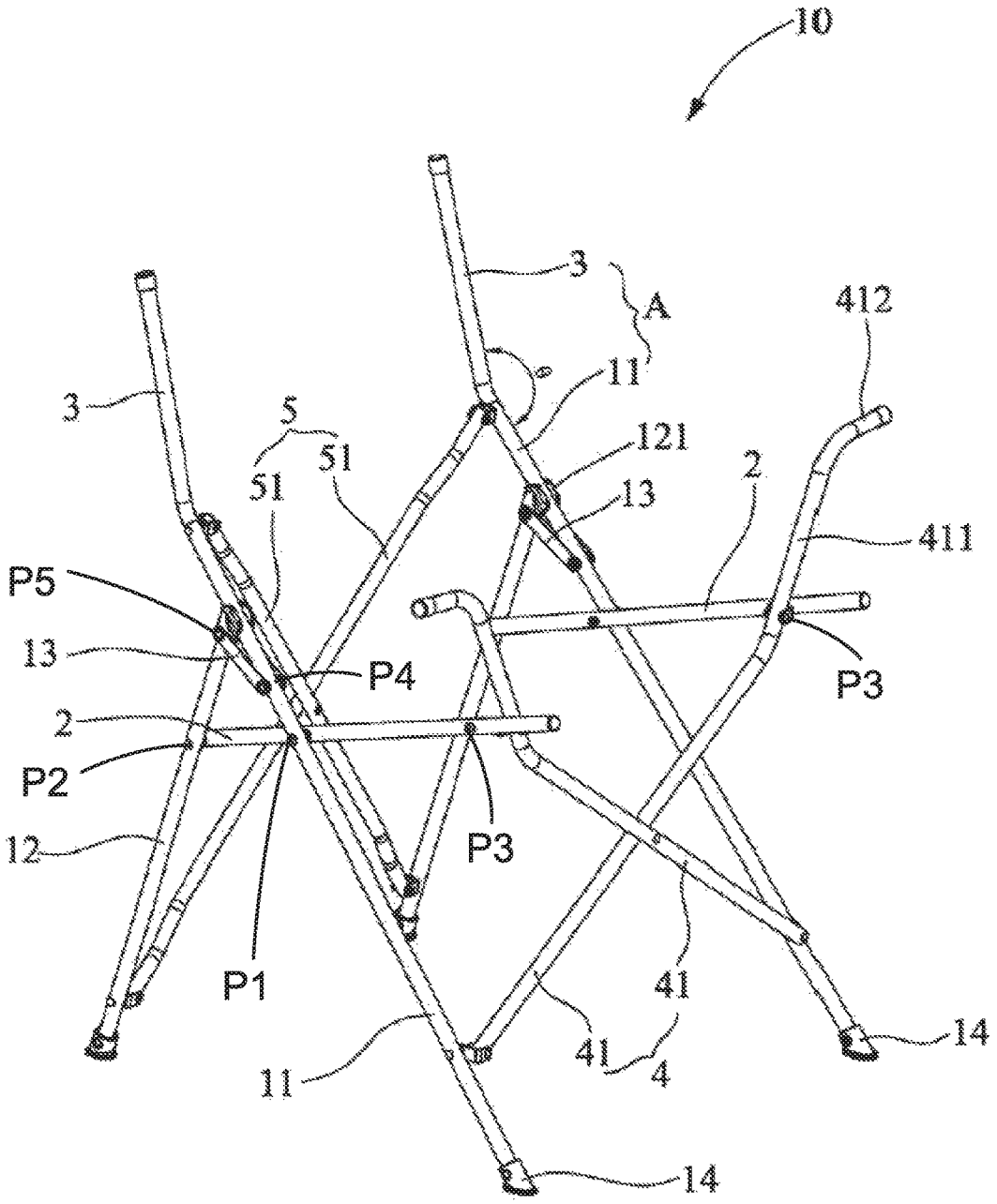
FIG. 3 is a perspective view schematically illustrating an exemplary foldable chair frame in an unfolded state in accordance with some exemplary embodiments of the present invention.
Figure 4:
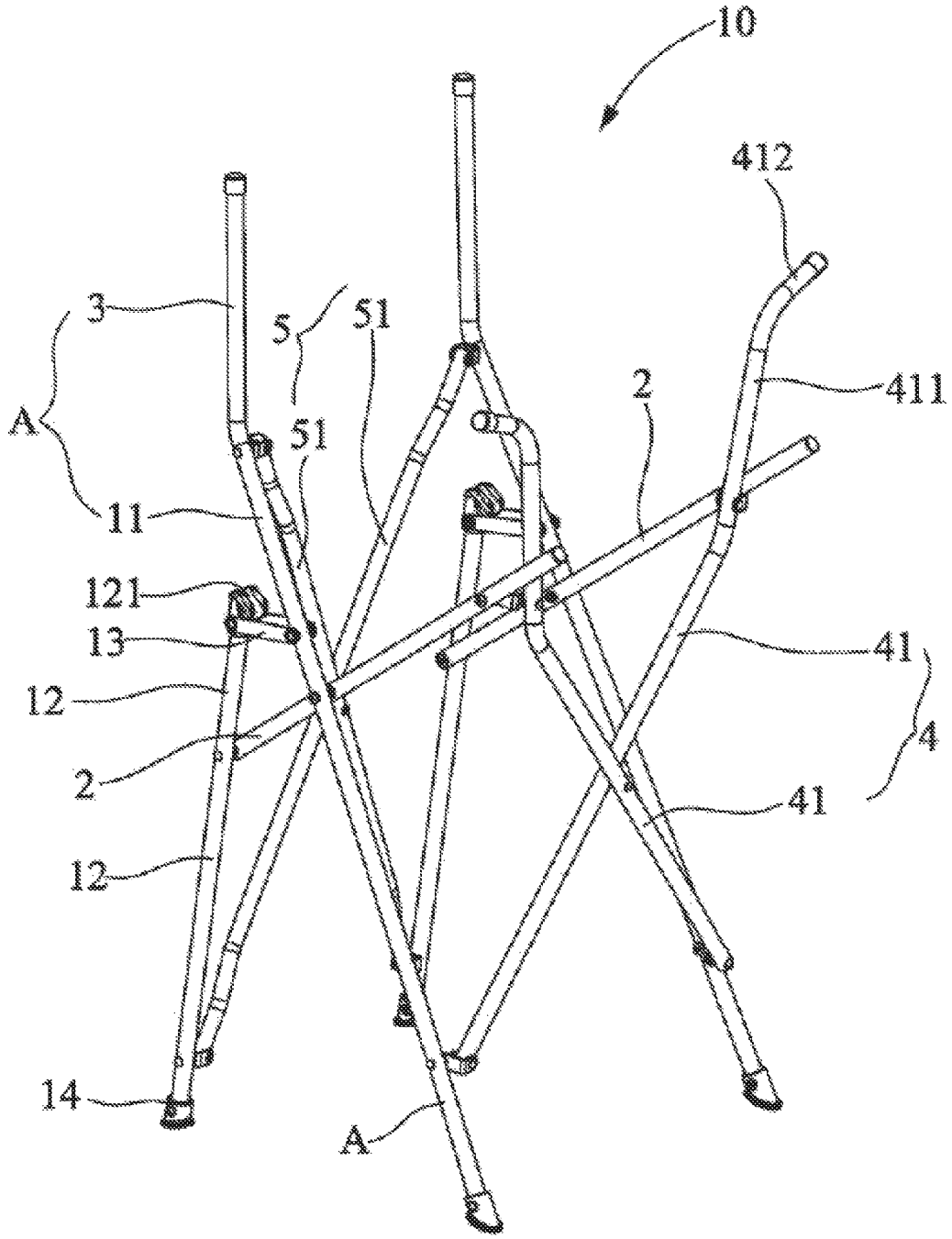
FIG. 4 is a perspective view schematically illustrating the foldable chair frame of FIG. 3 in a partially folded state.
Figure 5:
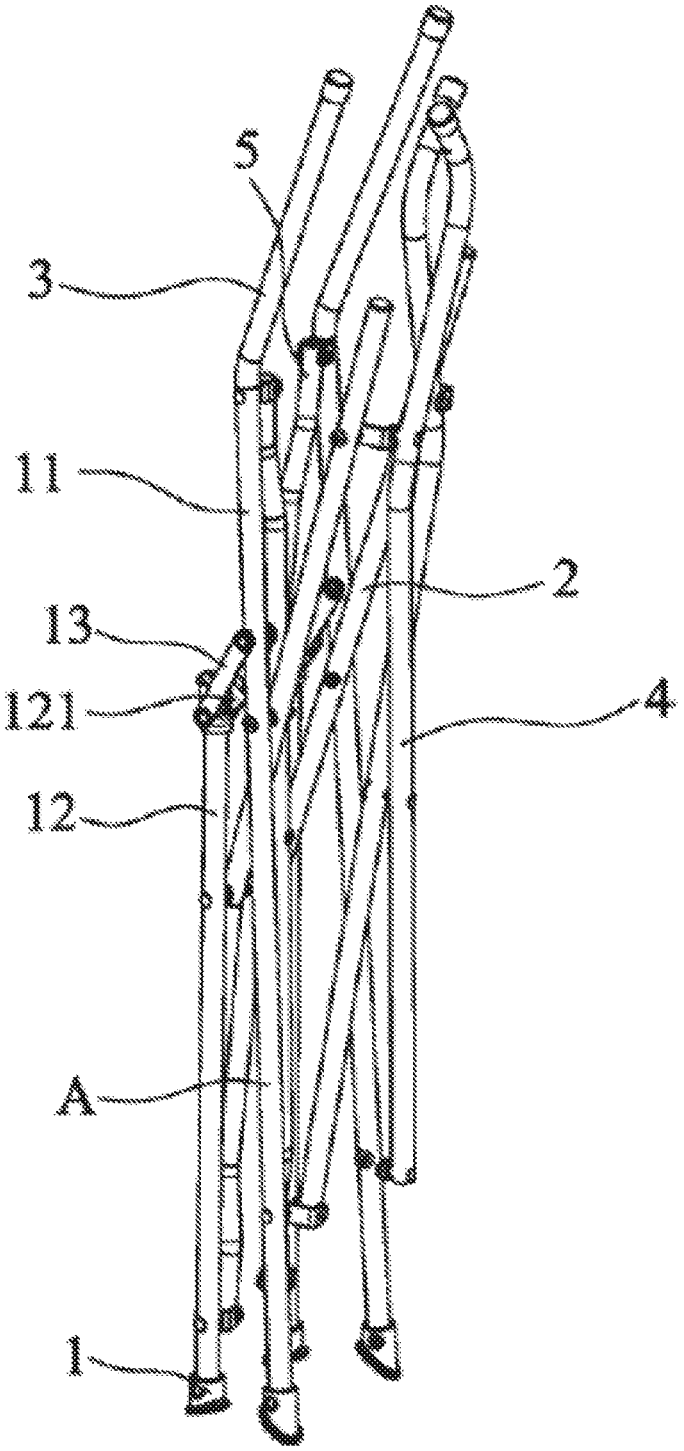
FIG. 5 is a perspective view schematically illustrating the foldable chair frame of FIG. 3 in a folded state.

Referring to FIGS. 3-5, there is depicted an exemplary foldable chair frame 10 in accordance with some embodiments of the present invention. Foldable chair frame 10 includes left and right side frames disposed at the left and right sides of the foldable chair frame, respectively. In various embodiments, the left and right side frames are substantially the same and symmetric to each other with respect to a vertical plane. In many embodiments, each of the left and right side frames includes a seat rod such as seat rod 2, a back rod such as backrest rod 3, a front leg such as front leg 11, a rear leg such as rear leg 12. Front leg 11 has an upper end, a lower end, and a first pivotal point (P1) between its upper and lower ends. Backrest rod 3 is integrally formed with the front leg and extended from the upper end of the front leg at an obtuse angle (180°θ°90°) with respect to the front leg. Collectively, the integrally formed front leg and backrest rod are designated as "A" in the figures. In an exemplary embodiment, the backrest rod and the front leg are formed of one piece, for instance, by extrusion or by bending a bar or rod. The integrally formed backrest rod and front rod improve the stability and firmness of the foldable chair frame. Along with other features disclosed herein, the integrally formed backrest rod and front rod also improve seating comfort, makes folding and unfolding of the foldable chair frame easier and simpler, and makes the unfolded chair frame more compact.

Rear leg 12 has an upper end, a lower end, and a second pivotal point (P2) between its upper and lower ends. The upper end of the rear leg is configured to abut and support the front leg when the foldable chair frame is unfolded as illustrated in FIG. 3. Seat rod 2 has a rear end pivotally connected to the rear leg at the second pivotal point (P2), and a middle portion pivotally connected to the front leg at the first pivotal point (P1). It should be noted that the term "pivotally connected to", "pivotally coupled to", or "pivotal connection" refers to both direct coupling and indirect coupling (e.g., through a connector or other suitable means) of two or more components.

In various embodiments, the obtuse angle (θ), the first pivotal point (P1) and the second pivotal point (P2) are configured such that when the foldable chair frame is unfolded, front leg 11 is inclined backward, rear leg 12 is inclined forward, and backrest rod 2 is inclined slightly backward (e.g., the backrest rod is inclined backward with an inclination angle less than an inclination angle of the front leg). The slightly backward inclination of the backrest rod promotes comfort and ergonomic seating. In some embodiments, with respect to the ground on which the foldable chair frame is placed, backrest rod 2 is inclined backward with an obtuse angle between 95° and 120°. In an embodiment, backrest rod 2 is inclined backward with an obtuse angle between 100° and 110°.

In some embodiments, the first pivotal point (P1) and the second pivotal point (P2) are configured such that seat rod 2 is horizontal, or tilted slightly upward with the front end higher than the rear end. The slightly upward tilting of the seat rod helps users to maintain good contact with the backrest. In some embodiments, with respect to the ground on which the foldable chair frame is placed, seat rod 2 is tilted upward with an angle between 2° and 20°. In an embodiment, seat rod 2 is tilted upward with an angle between 5° and 10°.

Foldable chair frame 10 also includes a plurality of supporting rods such as front supporting rods 4 and rear supporting rods 5 to connect the left and right side frames. The front supporting rods are disposed between the left and right side frames at a front side of the foldable chair frame, and pivotally connected to the left and right side frames. The rear supporting rods are disposed between the left and right side frames at a rear side of the foldable chair frame, and pivotally connected to the left and right side frames.

In some embodiments, front supporting rods 4 are composed of a pair of crossing front supporting rods 41 disposed between the left and right side frames at the front side of the foldable chair frame. Each crossing front supporting rod 41 has a lower end pivotally connected to a lower portion of front leg 11 of one of the left and right side frames, and an upper portion pivotally connected to a front portion of seat rod 2 of the other of the left and right side frames at a third pivotal point (P3). In an embodiment, the upper portion of each crossing front supporting rod in the pair includes first segment 411 extending upward and/or outward from and beyond the third pivotal point when the foldable chair frame is unfolded. In an embodiment, the upper portion of each crossing front supporting rod in the pair includes first segment 411 and second segment 412 extending from the first segment. In such an embodiment, when the foldable chair frame is unfolded, the first segment extends substantially upward from the third pivotal point, and the second segment extends substantially outward from the first segment. The extended upper portion, in some cases together with a chair cloth, serves as an armrest.

In some embodiments, rear supporting rods 5 are composed of a pair of crossing rear supporting rods 51 disposed between the left and right side frames at the rear side of the foldable chair frame. Each crossing rear supporting rod in the pair has a lower end pivotally connected to a lower portion of the rear leg of one of the left and right side frames and an upper end pivotally connected to the upper end or an upper end portion of the front leg of the other of the left and right side frames.

In some embodiments, rear leg 12 includes a holder, such as holder 121 illustrated in FIG. 4, at the upper end of the rear leg. Holder 121 is configured to receive and hold the front leg when the foldable chair frame is unfolded. Examples of holder 121 include but not limited to a groove formed at the upper end of the rear leg or a bracket attached to the upper end of the rear leg.

In some embodiments, each of the left and right side frames further includes a link pivotally connected to the front and rear legs. For instance, FIGS. 3 and 4 illustrate link 13 having one end pivotally connected to front leg 11 at a fourth pivotal point (P4) between the upper end and the first pivotal point (P1) of the front leg, and the other end pivotally connected to rear leg 12 at a fifth pivotal point (P5) between the upper end and the second pivotal point (P2) of the rear leg. In some embodiments, the link includes two connecting pieces substantially parallel to each other, with one connecting piece on an interior side and the other on an exterior side of the foldable chair frame. In an embodiment, the fifth pivotal point is adjacent to the upper end of the rear leg.

In some embodiments, the foldable chair frame further includes a plurality of leg base covers 14, each coupled to a front or a rear leg at its lower end. In an embodiment, each leg base cover is sleeved onto the lower end of the front or rear leg. The leg base covers can be made of any suitable materials including but not limited to plastics and rubbers.

Figure 1:
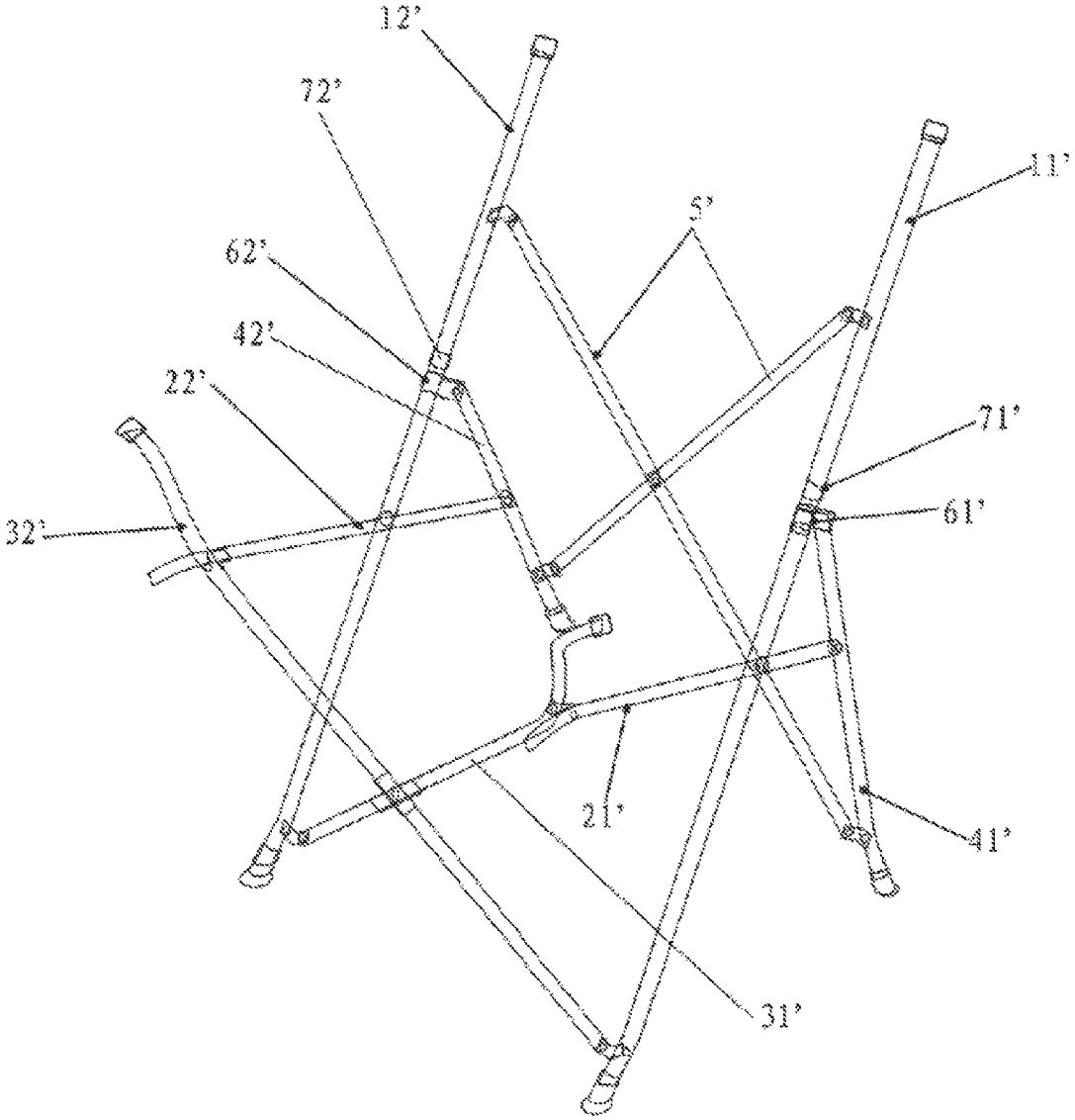
FIG. 1 (Related Art)
FIG. 1 is a perspective view illustrating a foldable chair frame of a related art.
Figure 2:
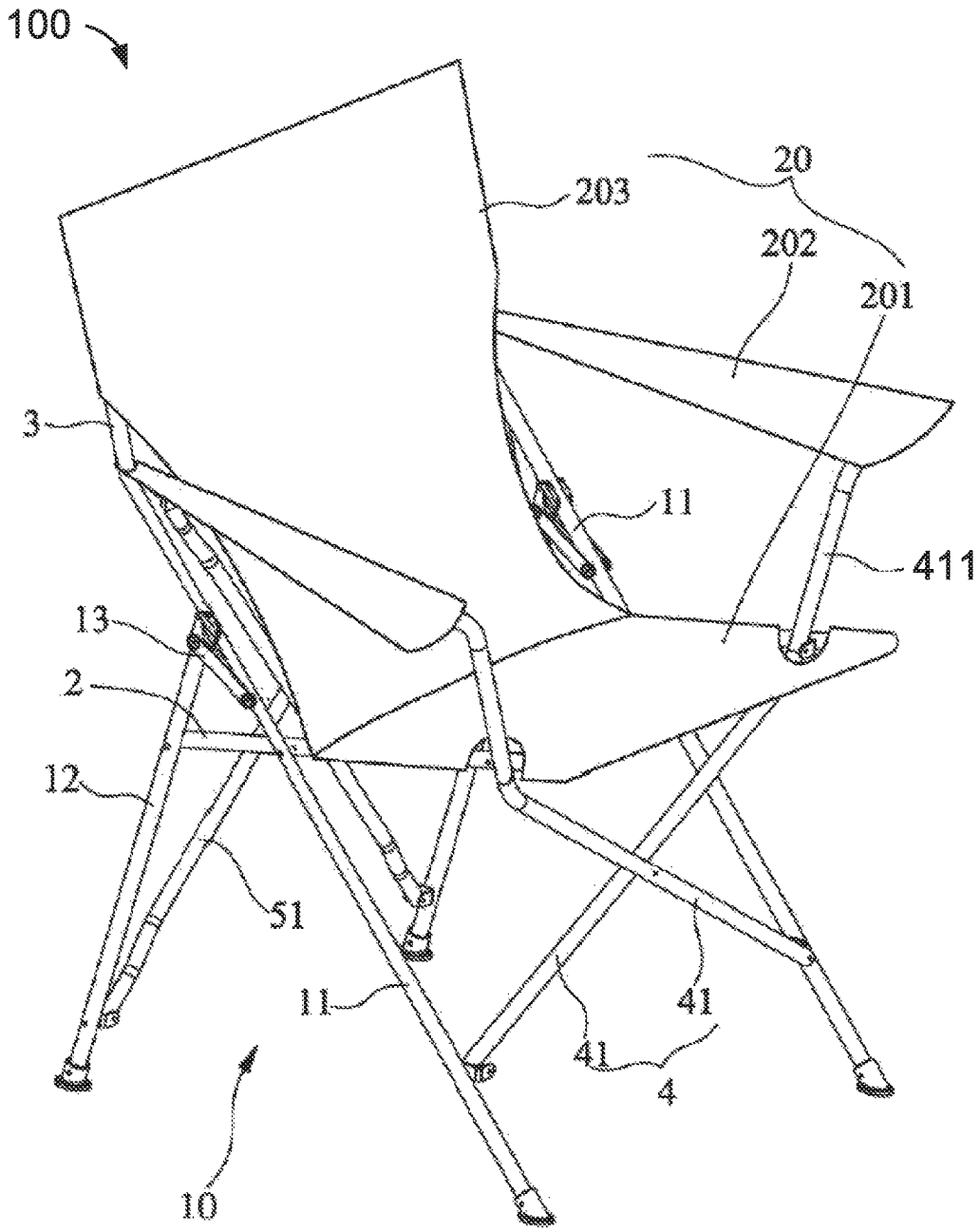
FIG. 2 is a perspective view schematically illustrating an exemplary foldable chair in accordance with some exemplary embodiments of the present invention.

Referring to FIG. 2, there is depicted exemplary foldable chair 100 in accordance with some embodiments of the present invention. As shown, foldable chair 100 includes a chair frame such as chair frame 10 disclosed herein, and a chair cloth such as chair cloth 20 coupled to the foldable chair frame. In some embodiments, the chair cloth includes a plurality of cloths each serving a specific function. For instance, by way of example, FIG. 2 illustrate chair cloth 20 including backrest cloth 203, seat cloth 201 and left and right armrest cloths 202. The backrest cloth is coupled to the backrest rods, for example, sleeved onto the backrest rods. The seat cloth is coupled to (e.g., sleeved onto) the seat rods. Each of the left and right armrest cloths is coupled to the corresponding front leg or backrest rod at the rear end, for example, through a hole formed at the rear end of the armrest cloth. Each of the left and right armrest cloths is also coupled to the upper portion of the corresponding front support rod at the front end.

In an embodiment, the backrest cloth and the seat cloth are stitched together. In an embodiment, the backrest cloth and the seat cloth are made of one piece of fabric.

As disclosed herein, the front leg and the corresponding backrest rod are integrally made of one piece, and the legs and supporting rods are pivotally connected to each other. As such, folding and unfolding of the foldable chair frame or the foldable chair having such a chair frame is simple and easy. For instance, FIGS. 4 and 5 illustrate an exemplary folding process. First, release the front legs (along with the backrest rods integrally formed with the front legs) from the holders of the rear legs. Then, push the left and right frames toward each other. As a result, the crossing supporting rods in each pair (e.g., the pair of the front supporting rods 41 or the pair of the rear supporting rods 51) are rotated toward each other. Through the pivotal connections, the rotation of the crossing supporting rods in turn rotates the seat rods, the front legs and/or the rear legs, thereby bringing the front legs, the seat rods and the rear legs toward each other. Eventually, all of the legs and rods are brought together, as illustrated in FIG. 5. To unfold the foldable chair or the foldable chair frame, simply unfold (e.g., separate and extend) one or more legs or rods (e.g. the backrest rods along the front legs, the seat rods or the front supporting rods). The remaining rods and legs will be unfolded cooperatively through the pivotal connections.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "front" or "rear", "backward" or "forward", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first pivotal point could be termed a second pivotal point, and, similarly, a second pivotal point could be termed a first pivotal point, without changing the meaning of the description, so long as all occurrences of the "first pivotal point" are renamed consistently and all occurrences of the "second pivotal point" are renamed consistently.

What is claimed is:

1. A foldable chair frame, comprising:

left and right side frames at left and right sides of the foldable chair frame, each comprising:

a front leg having an upper end, a lower end, and a first pivotal point between the upper and lower ends thereof;

a backrest rod integrally formed with the front leg and extended from the upper end of the front leg at an obtuse angle with respect to the front leg;

a rear leg having an upper end, a lower end, and a second pivotal point between the upper and lower ends thereof, wherein the upper end of the rear leg comprises a holder with an opening to receive the front leg when the foldable chair frame is unfolded and to allow the front leg to be detached from the upper end of the rear leg when the foldable chair frame is folded, wherein the holder surrounds at least half of a circumference of the front leg to hold the front leg when the foldable chair frame is unfolded; and a seat rod having a rear end pivotally connected to the rear leg at the second pivotal point, and a middle portion pivotally connected to the front leg at the first pivotal point;

a plurality of front supporting rods disposed between the left and right side frames at a front side of the foldable chair frame, and pivotally connected to the left and right side frames; and a plurality of rear supporting rods disposed between the left and right side frames at a rear side of the foldable chair frame, and pivotally connected to the left and right side frames.

2. The foldable chair frame of claim 1, wherein the plurality of front supporting rods comprises a pair of crossing front supporting rods disposed between the left and right side frames at the front side of the foldable chair frame, wherein each crossing front supporting rod has a lower end pivotally connected to a lower portion of the front leg of one of the left and right side frames, and an upper portion pivotally connected to a front portion of the seat rod of the other of the left and right side frames at a third pivotal point.

3. The foldable chair frame of claim 2, wherein when the foldable chair frame is unfolded, the upper portion of each crossing front supporting rod in the pair extends upward, outward, or upward and outward, beyond the third pivotal point, the extended upper portion serving as an armrest.

4. The foldable chair frame of claim 1, wherein the plurality of rear supporting rods comprises a pair of crossing rear supporting rods disposed between the left and right side frames at a rear side of the foldable chair frame, wherein each crossing rear supporting rod in the pair has a lower end pivotally connected to a lower portion of the rear leg of one of the left and right side frames and an upper end pivotally connected to the upper end or an upper end portion of the front leg of the other of the left and right side frames.

5. The foldable chair frame of claim 1, wherein the obtuse angle, the first pivotal point and the second pivotal point are configured such that when the foldable chair frame is unfolded, the front leg is inclined backward, the rear leg is inclined forward, and the backrest rod is inclined backward with an inclination angle less than an inclination angle of the front leg.

6. The foldable chair frame of claim 5, wherein when unfolded, the seat rod is titled upward at an angle ranging from 2° to 20° with respect to a ground.

7. The foldable chair frame of claim 1, wherein each of the left and right side frames further comprises a link having one end pivotally connected to the front leg at a fourth pivotal point between the upper end and the first pivotal point of the front leg, and the other end pivotally connected to the rear leg at a fifth pivotal point between the upper end and the second pivotal point of the rear leg.

8. The foldable chair frame of claim 7, wherein the fifth pivotal point is adjacent to the upper end of the rear leg.

9. The foldable chair frame of claim 7, wherein the link comprises two connecting pieces substantially parallel to each other, one on an interior side and the other on an exterior side of the foldable chair frame.

10. The foldable chair frame of claim 1, further comprising a plurality of leg base covers, each coupled to a front or a rear leg at the lower end thereof.

11. The foldable chair frame of claim 10, wherein the plurality of leg base covers is made of a plastic or a rubber.

12. The foldable chair frame of claim 10, wherein each leg base cover is sleeved onto the lower end of the front or rear leg.

13. A foldable chair, comprising:

the foldable chair frame of claim 1;

a chair cloth coupled to the foldable chair frame.

14. The foldable chair of claim 13, further comprising a plurality of leg base covers, each coupled to a front or a rear leg at the lower end thereof.

15. The foldable chair of claim 13, wherein the plurality of front supporting rods comprises a pair of crossing front supporting rods disposed between the left and right side frames at the front side of the foldable chair frame, wherein each crossing front supporting rod has a lower end pivotally connected to a lower portion of the front leg of one of the left and right side frames, and an upper portion pivotally connected to a front portion of the seat rod of the other of the left and right side frames at a third pivotal point.

16. The foldable chair of claim 15, wherein the foldable chair cloth comprises:

a backrest cloth coupled to the backrest rods;

a seat cloth coupled to the seat rods; and left and right armrest cloths at left and right sides of the foldable chair, each having one end coupled to the corresponding front leg or backrest rod, and the other end coupled to the upper portion of the corresponding front support rod.

17. The foldable chair of claim 16, wherein the backrest cloth and the seat cloth are made of one piece of fabric or are stitched together.

18. The foldable chair of claim 15, wherein when the foldable chair is unfolded, the upper portion of each crossing front supporting rod extends upward, outward, or upward and outward, beyond the third pivotal point, wherein the extended upper portion is coupled with a left or a right armrest cloth of the chair cloth, collectively serving as an armrest.

19. The foldable chair of claim 13, wherein the plurality of rear supporting rods comprises a pair of crossing rear supporting rods disposed between the left and right side frames at a rear side of the foldable chair frame, wherein each crossing rear supporting rod in the pair has a lower end pivotally connected to a lower portion of the rear leg of one of the left and right side frames and an upper end pivotally connected to the upper end or an upper end portion of the front leg of the other of the left and right side frames.

20. The foldable chair of claim 13, wherein each of the left and right side frames further comprises a link having one end pivotally connected to the front leg at a fourth pivotal point between the upper end and the first pivotal point of the front leg, and the other end pivotally connected to the rear leg at a fifth pivotal point between the upper end and the second pivotal point of the rear leg.

21. The foldable chair of claim 13, wherein the obtuse angle, the first pivotal point and the second pivotal point are configured such that when the foldable chair frame is unfolded, the front leg is inclined backward, the rear leg is inclined forward, and the backrest rod is inclined backward with an inclination angle less than an inclination angle of the front leg.

22. The foldable chair of claim 21, wherein when unfolded, the seat rod is titled upward at an angle ranging from 2° to 20° with respect to a ground.

* * * * *